US005813187A

United States Patent [19]

Lee

[11] Patent Number: 5,813,187

[45] Date of Patent: Sep. 29, 1998

[54] METAL BARRIER FOR A WINDOW OR DOOR FOR PROHIBITING BURGLARS FROM BREAKING IN

[76] Inventor: Ming-Kun Lee, 2/F., No. 13, Hsing-Nan St., Nan-Kang Dist. Taipei City, Taiwan

[21] Appl. No.: 884,651

[22] Filed: Jun. 27, 1997

[51] Int. Cl.[6] ..... E04C 2/42

[52] U.S. Cl. ..... 52/664; 52/106; 52/667

[58] Field of Search ..... 52/667, 668, 664, 52/106, 656.8; 49/50

[56] References Cited

U.S. PATENT DOCUMENTS

| | | | |
|---|---|---|---|
| 180,232 | 8/1876 | Heinz | 52/667 X |
| 220,505 | 10/1879 | Streeter | 52/664 |
| 450,678 | 4/1891 | Pauly | 52/668 |
| 469,520 | 2/1892 | Hale | 52/667 X |
| 469,635 | 2/1892 | Hale | 52/667 X |
| 1,101,745 | 6/1914 | Jones | 52/667 X |
| 1,354,821 | 10/1920 | Garratt | 52/667 |
| 1,791,680 | 2/1931 | Miller | 52/656.8 X |
| 1,954,559 | 4/1934 | Crandall | 52/667 X |
| 3,736,714 | 6/1973 | Brenner | 52/667 X |
| 3,942,764 | 3/1976 | Beverdorf | 52/667 X |
| 5,609,002 | 3/1997 | Fernnandez | 52/667 X |

*Primary Examiner*—Robert Canfield

*Attorney, Agent, or Firm*—Rosenberg, Klein & Bilker

[57] ABSTRACT

A metal barrier including a rectangular metal frame having a plurality of plug holes on the inside on two opposite vertical sides and two opposite horizontal sides thereof; a plurality of transverse metal tubes mounted within the rectangular metal frame and having respective both ends respectively and fitted into the plug holes on the opposite vertical sides of the rectangular metal frame, each transverse metal tube having a row of through holes; and a plurality of longitudinal metal tubes intersected with the transverse metal tubes and mounted within the rectangular metal frame, the longitudinal metal tubes being respectively inserted through the through holes of the transverse metal tubes and having respective both ends respectively fitted into the plug holes on the opposite horizontal sides of the rectangular metal frame.

6 Claims, 7 Drawing Sheets

METAL BARRIER FOR A WINDOW OR DOOR FOR PROHIBITING BURGLARS FROM BREAKING IN

BACKGROUND OF THE INVENTION

The present invention relates to metal barriers for windows/doors for prohibiting burglars from breaking in, and more particularly to such a metal barrier which is strong, easy and inexpensive to manufacture.

In a regular metal barrier for a window or door for prohibiting burglars from breaking as shown in FIG. 8, the transverse metal tubes (5) have notches (51); the longitudinal metal tubes (6) are respectively attached to the notches (51); substantially U-shaped metal connecting plates 52 are respectively connected between the metal tubes (5;6) and the side bars (7) by rivets. This structure of metal barrier is nut so strong, because the longitudinal metal tubes (6) can easily be deformed and removed out of the notches (51) of the transverse metal tubes (5).

SUMMARY OF THE INVENTION

The present invention has been accomplished to provide a metal barrier for windows/doors for prohibiting burglars from breaking in which eliminates the aforesaid problem. It is one object of the present invention to provide a metal barrier which is so strong that burglars cannot break in. It is another object of the present invention to provide a metal barrier which is easy and inexpensive to manufacture. According to one aspect of the present invention, the metal barrier comprises a rectangular metal frame having a plurality of plug holes on the inside on two opposite vertical sides and two opposite horizontal sides thereof; a plurality of transverse metal tubes mounted within the rectangular metal frame and having respective both ends respectively and fitted into the plug holes on the opposite vertical sides of the rectangular metal frame, each transverse metal tube having a row of through holes; and a plurality of longitudinal metal tubes intersected with the transverse metal tubes and mounted within the rectangular metal frame, the longitudinal metal tubes being respectively inserted through the through holes of the transverse metal tubes and having respective both ends respectively fitted into the plug holes on the opposite horizontal sides of the rectangular metal frame. According to another aspect of the present invention, the transverse metal tubes and the longitudinal metal tubes can be square tubes, having each four sides and four angles and four narrow connecting wall portions respectively and longitudinally disposed in its four angles between each two adjacent sides and respectively curved inwards or outwards.

DETAILED DESCRIPTION OF THE PREFERRED EMBODIMENT

Figure 1:
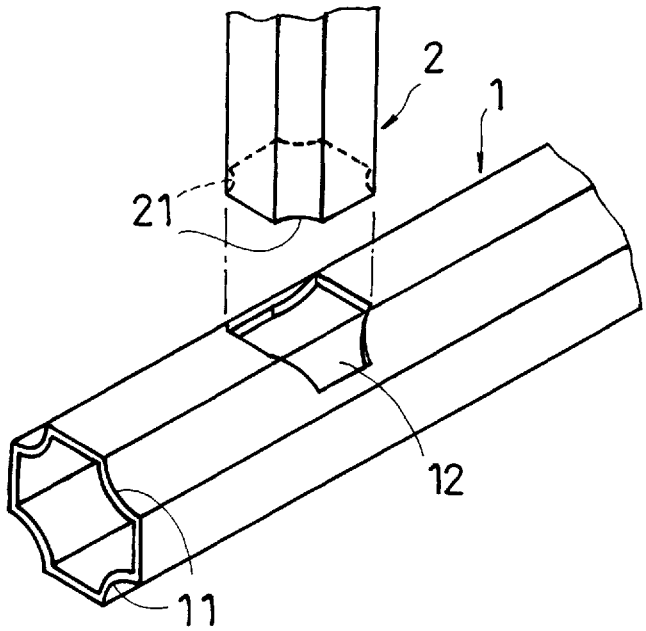
FIG. 1 shows one transverse metal tube and one longitudinal metal tube for a metal barrier according to a first embodiment of the present invention.
Figure 2:
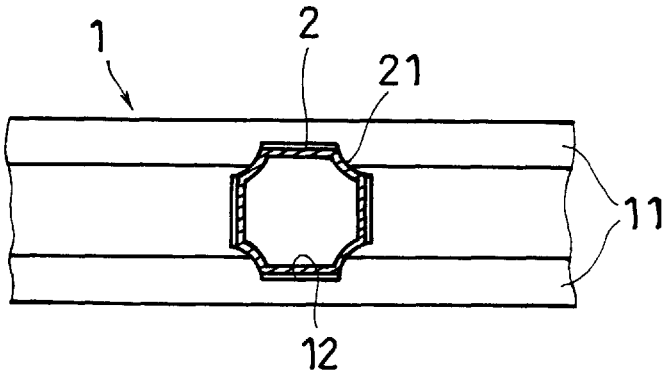
FIG. 2 is a top view in section showing the transverse metal tube and the longitudinal metal tube of the first embodiment of the present invention connected together.
Figure 3:
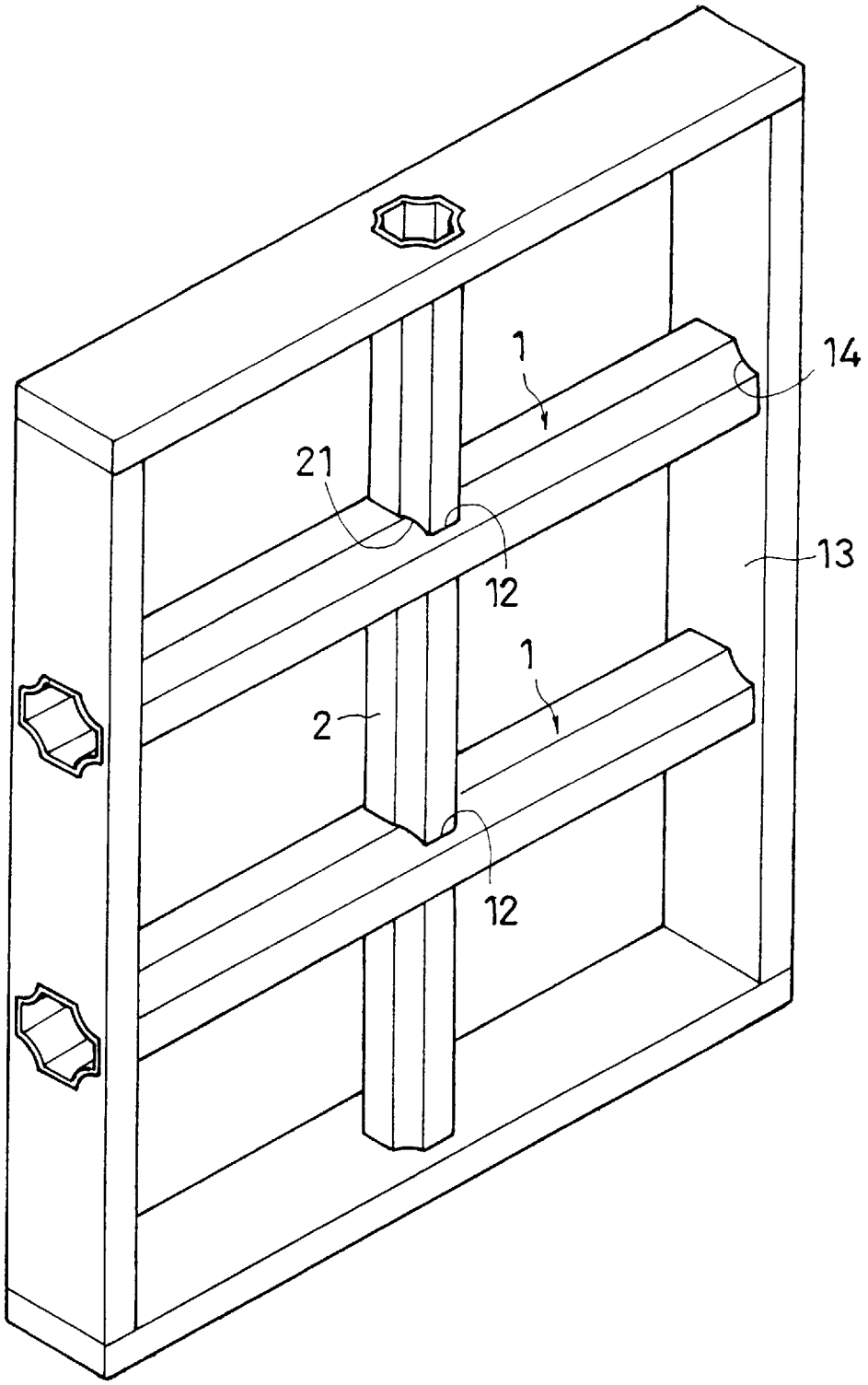
FIG. 3 is a elevational view of a metal barrier according to the first embodiment of the present invention.

Referring to FIGS. 1, 2 and 3, a metal barrier (not shown) in accordance with the present invention is generally comprised of a rectangular frame (not shown) which is comprised of four metal rails 13 connected together, a plurality of transverse metal tubes 1 and a plurality of longitudinal metal tubes 2 intersected together and mounted within the rectangular frame of the metal rails 13. Each metal tube 1 or 2 has four narrow connecting wall portions 11 or 21 respectively and longitudinally disposed in its four angles between each two adjacent sides and respectively curved inwards. The narrow connecting wall portions 11;21 reinforce the bending strength of the metal tube 1;2. Each transverse metal tube 1 has a plurality of through holes 12 longitudinally arranged in a line and adapted for receiving the longitudinal metal tubes 2. The through holes 12 fit the cross section of the longitudinal metal tubes 2, so that the transverse metal tubes 1 and the longitudinal metal tubes 2 are firmly intersected together when the longitudinal metal tubes 2 are respectively inserted into the through holes 12 of the transverse metal tubes 1. The four metal rails 13 have a respective row of plug holes 14 adapted for receiving the transverse metal tubes 1 or the longitudinal metal tubes 2. The plug holes 14 fit the cross section of the metal tubes 1;2.

Figure 4A:
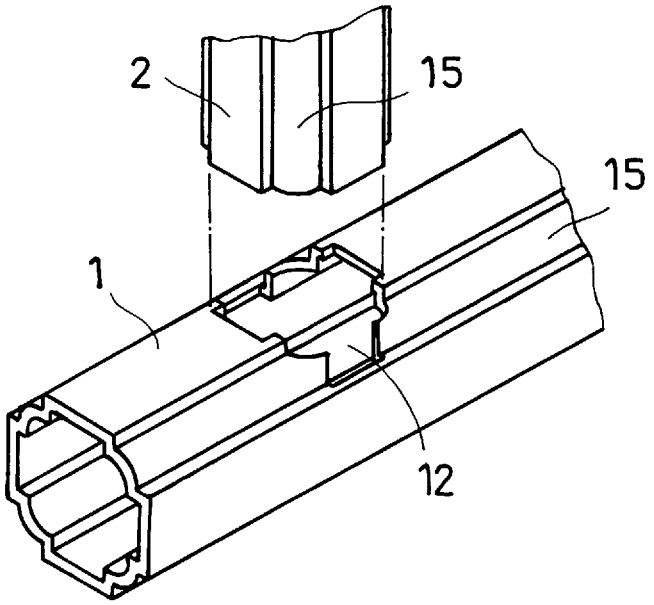
FIG. 4A shows one transverse metal tube and one longitudinal metal tube for a metal barrier according to a second embodiment of the present invention.
Figure 4B:
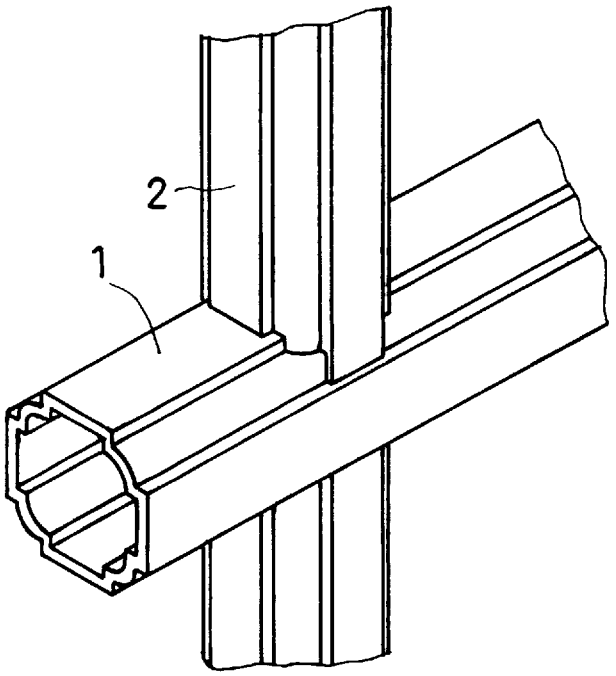
FIG. 4B is an assembly view of FIG. 4A.

FIGS. 4A and 4B show an alternate form of the present invention, in which the metal tube 1 or 2 has four narrow connecting wall portions 15 or 25 respectively and longitudinally disposed in its four angles between each two adjacent sides and respectively curved outwards.

Figure 5A:
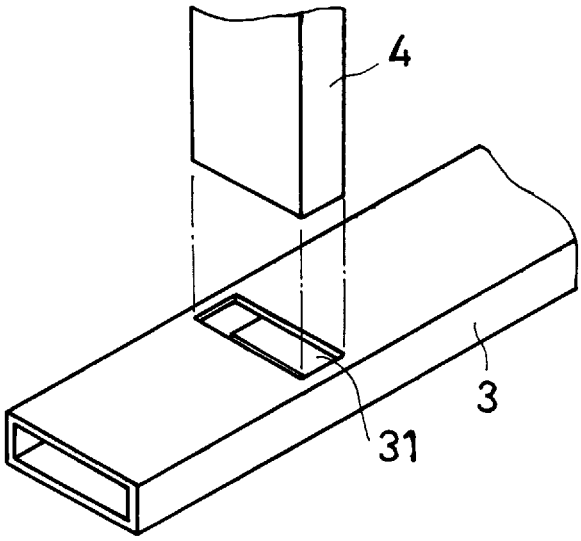
FIG. 5A shows one transverse metal tube and one longitudinal metal tube for a metal barrier according to a third embodiment of the present invention.
Figure 5B:
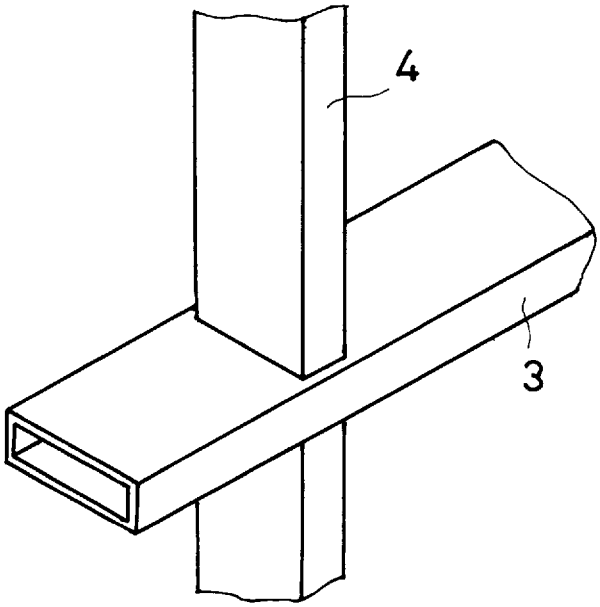
FIG. 5B is an assembly view of FIG. 5A.

FIGS. 5A and 5B show another alternate form of the present invention, in which the transverse metal tube 3 and the longitudinal metal tube 4 are rectangular flat tubes; the through holes 31 of the transverse metal tube 3 are rectangular through holes fitting the cross section of the longitudinal metal tube 4.

Figure 6A:
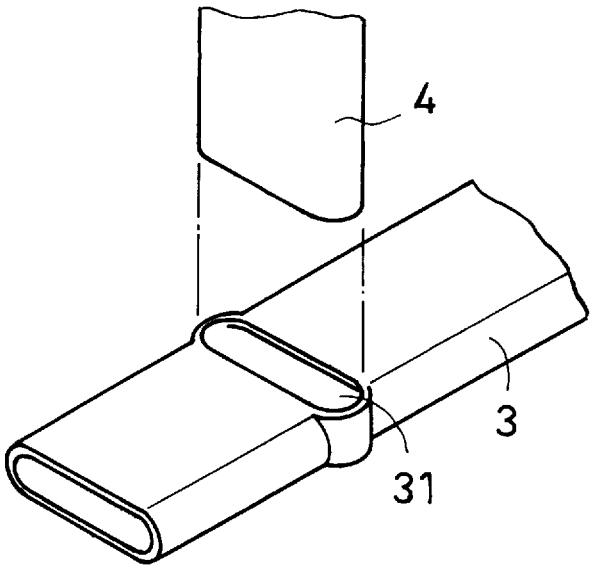
FIG. 6A shows one transverse metal tube and on longitudinal metal tube for a metal barrier according to a fourth embodiment of the present invention.
Figure 6B:
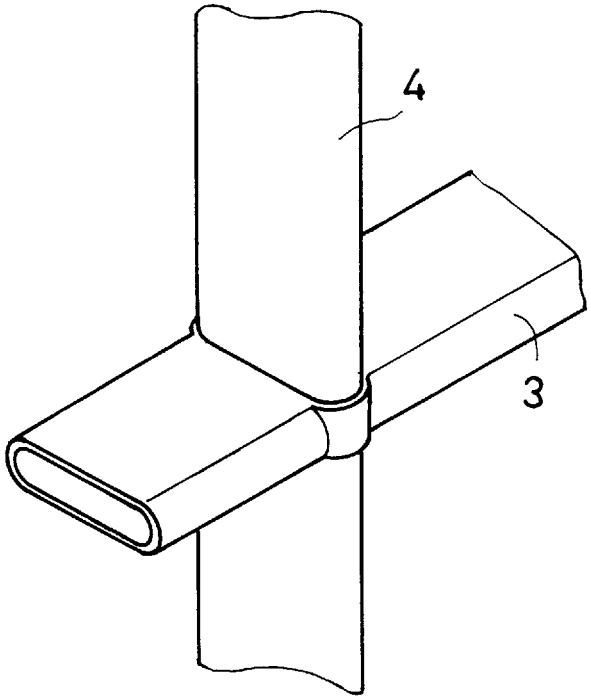
FIG. 6B is an assembly view of FIG. 6A.

FIGS. 6A and 6B show still another alternate form of the present invention, in which the transverse metal tube 3 and the longitudinal metal tube 4 are oblong tubes; the through holes 31 of the transverse metal tube 3 are oblong through holes fitting the cross section of the longitudinal metal tube 4.

Figure 7A:
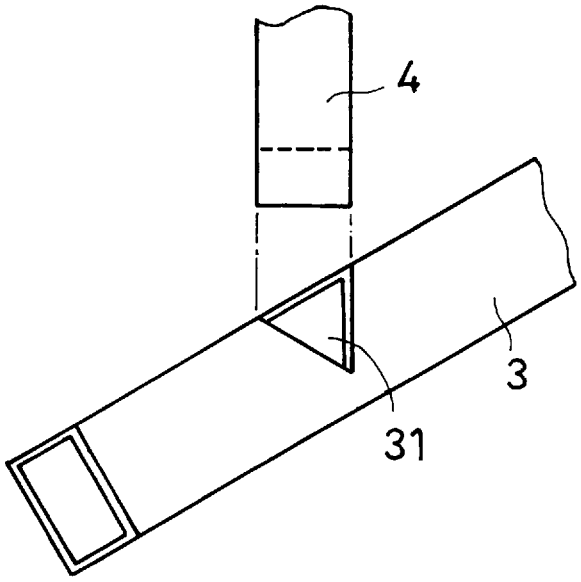
FIG. 7A shows one transverse metal tube and on longitudinal metal tube for a metal barrier according to a fifth embodiment of the present invention.
Figure 7B:
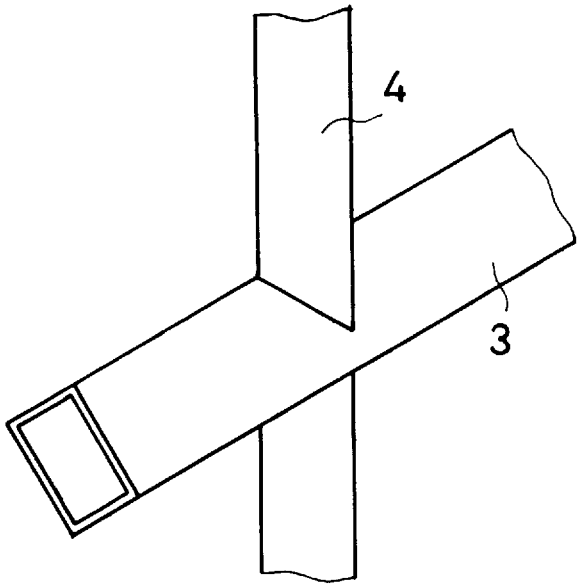
FIG. 7B is an assembly view of FIG. 7A.
Figure 8:
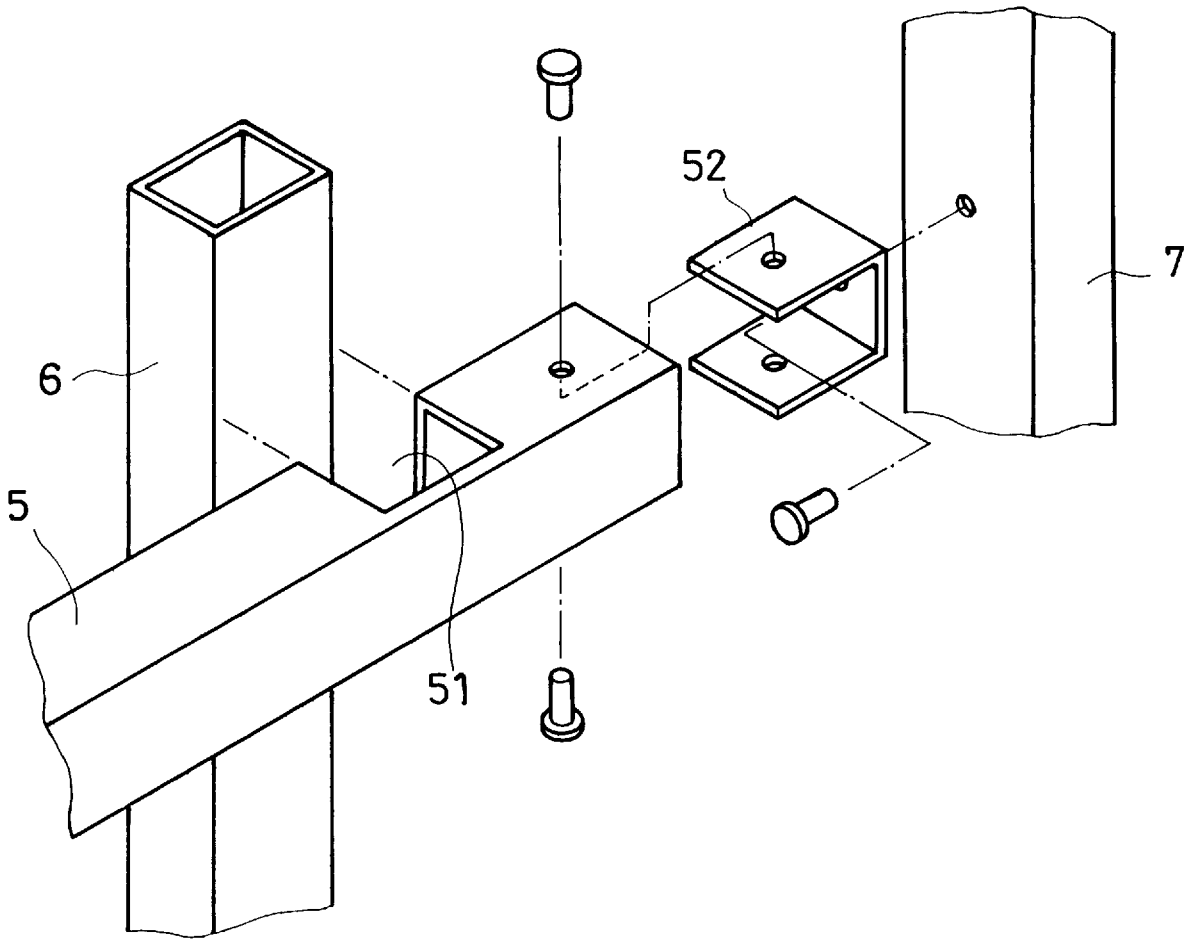
FIG.8 PRIOR ART
FIG. 8 is a partial view of a metal barrier according to the prior art.

FIGS. 7A and 7B show still another alternate form of the present invention, in which the transverse metal tube 3 is a diamond-shaped tube, the through holes 31 of the transverse metal tube 3 are diamond-shaped through holes, and the longitudinal metal tube 4 is a diamond-shaped tube fitting the diamond-shaped through holes 31 of the transverse metal tube 3.

It is to be understood that the drawings are designed for purposes of illustration only, and are not intended as a definition of the limits and scope of the invention disclosed.

What the invention claimed is:

1. A metal barrier comprising:

a metal frame formed by four rail members, each of said rail members having a plurality plug holes formed therein;

a plurality of transverse tubular metal members mounted within said metal frame and having respective ends thereof respectively fitted into said plug holes on opposing vertical sides of said metal frame, each of said plurality of transverse tubular metal members having a plurality of spaced holes formed therethrough; and, a plurality of longitudinal tubular metal members intersecting said transverse tubular metal members and being mounted in said metal frame, each of said plurality of longitudinal tubular metal members being respectively inserted through a respective one of said plurality of holes in each of said plurality of transverse tubular metal members and having respective ends thereof respectively fitted into said plug holes on opposing horizontal sides of said metal frame.

2. A metal barrier comprising:

a metal frame formed by four rail members, each of said rail members having a plurality plug holes formed therein;

a plurality of transverse metal tubes mounted within said metal frame and having respective ends thereof respectively fitted into said plug holes on opposing vertical sides of said metal frame, each of said plurality of transverse metal tubes having a plurality of spaced holes formed therethrough: and, a plurality of longitudinal metal tubes intersecting said transverse metal tubes and being mounted in said metal frame, each of said plurality of longitudinal metal tubes being respectively inserted through a respective one of said plurality of holes in each of said plurality of transverse metal tubes and having respective ends thereof respectively fitted into said plug holes on opposing horizontal sides of said metal frame, said transverse metal tubes and said longitudinal metal tubes having a predetermined cross-sectional contour, said cross-sectional contour being defined by four sides, and four narrow connecting wall portions respectively disposed between each two adjacent sides and respectively curved inwardly, said plurality of holes of said transverse metal tubes having a cross-sectional contour corresponding to said predetermined cross-sectional contour of said longitudinal metal tubes.

3. A metal barrier comprising:

a metal frame formed by four rail members, each of said rail members having a plurality plug holes formed therein:

a plurality of transverse metal tubes mounted within said metal frame and having respective ends thereof respectively fitted into said plug holes on opposing vertical sides of said metal frame, each of said plurality of transverse metal tubes having a plurality of spaced holes formed therethrough; and, a plurality of longitudinal metal tubes intersecting said transverse metal tubes and being mounted in said metal frame, each of said plurality of longitudinal metal tubes being respectively inserted through a respective one of said plurality of holes in each of said plurality of transverse metal tubes and having respective ends thereof respectively fitted into said plug holes on opposing horizontal sides of said metal frame, said transverse metal tubes and said longitudinal metal tubes having a predetermined cross-sectional contour, said cross-sectional contour being defined by four sides, and four narrow connecting wall portions respectively disposed between each two adjacent sides and respectively curved outwardly, said plurality of holes of said transverse metal tubes having a cross-sectional contour corresponding to said predetermined cross-sectional contour of said longitudinal metal tubes.

4. A metal barrier comprising:

a metal frame formed by four rail members, each of said rail members having a plurality plug holes formed therein:

a plurality of transverse metal tubes mounted within said metal frame and having respective ends thereof respectively fitted into said plug holes on opposing vertical sides of said metal frame, each of said plurality of transverse metal tubes having a plurality of spaced holes formed therethrough; and, a plurality of longitudinal metal tubes intersecting said transverse metal tubes and being mounted in said metal frame, each of said plurality of longitudinal metal tubes being respectively inserted through a respective one of said plurality of holes in each of said plurality of transverse metal tubes and having respective ends thereof respectively fitted into said plus holes on opposing horizontal sides of said metal frame, said transverse metal tubes and said longitudinal metal tubes being defined by rectangular flat tubes, said plurality of holes of said transverse metal tubes each having a rectangular cross-sectional contour corresponding to said longitudinal metal tubes, said plug holes on opposing horizontal sides of said metal frame having a rectangular cross-sectional contour corresponding to said longitudinal metal tubes.

5. A metal barrier comprising:

a metal frame formed by four rail members, each of said rail members having a plurality plug holes formed therein;

a plurality of transverse metal tubes mounted within said metal frame and having respective ends thereof respectively fitted into said plug holes on opposing vertical sides of said metal frame, each of said plurality of transverse metal tubes having a plurality of spaced holes formed therethrough; and, a plurality of longitudinal metal tubes intersecting said transverse metal tubes and being mounted in said metal frame, each of said plurality of longitudinal metal tubes being respectively inserted through a respective one of said plurality of holes in each of said plurality of transverse metal tubes and having respective ends thereof respectively fitted into said plug holes on opposing horizontal sides of said metal frame, said transverse metal tubes and said longitudinal metal tubes being defined by oblong tubes, said plurality of holes of said transverse metal tubes each having a oblong cross-sectional contour corresponding to said longitudinal metal tubes, said plug holes of said metal frame having an oblong cross-sectional contour corresponding to said longitudinal metal tubes.

6. A metal barrier comprising a metal frame formed by four rail members, each of said rail members having a plurality plug holes formed therein;

a plurality of transverse metal tubes mounted within said metal frame and having respective ends thereof respectively fitted into said plug holes on opposing vertical sides of said metal frame, each of said plurality of transverse metal tubes having a plurality of spaced holes formed therethrough; and, a plurality of longitudinal metal tubes intersecting said transverse metal tubes and being mounted in said metal frame, each of said plurality of longitudinal metal tubes being respectively inserted through a respective one of said plurality of holes in each of said plurality of transverse metal tubes and having respective ends thereof respectively fitted into said plug holes on opposing horizontal sides of said metal frame, said transverse metal tubes and said longitudinal metal tubes having a diamond-shaped cross-sectional contour, said plurality of holes of said transverse metal tubes each having a diamond-shaped cross-sectional contour corresponding to said longitudinal metal tubes, said plug holes of said metal frame respectively having a cross-sectional contour corresponding to said transverse metal tubes and said longitudinal metal tubes.

* * * * *